US006945300B2

(12) United States Patent
Smith

(10) Patent No.: US 6,945,300 B2
(45) Date of Patent: Sep. 20, 2005

(54) MOUNTING SYSTEM FOR SHEET MATERIAL ON ROLL-UP DOORS

(76) Inventor: Marvin A. Smith, 5301 Beethoven St., #101, Los Angeles, CA (US) 90066

( * ) Notice: Subject to any disclaimer, the term of this patent is extended or adjusted under 35 U.S.C. 154(b) by 18 days.

(21) Appl. No.: 10/377,585

(22) Filed: Feb. 27, 2003

(65) Prior Publication Data

US 2004/0168778 A1 Sep. 2, 2004

(51) Int. Cl.[7] ..... E06B 3/32

(52) U.S. Cl. ..... 160/89; 160/329; 40/590; 40/603

(58) Field of Search ..... 160/89, 230, 329, 160/376, 378, 179; 40/603, 604; 52/222

(56) References Cited

U.S. PATENT DOCUMENTS 5,946,869 A * 9/1999 Zinbarg ..... 52/202
6,092,319 A * 7/2000 Hicks ..... 40/603
6,276,082 B1 8/2001 Richards et al. ..... 40/603
6,282,822 B1 * 9/2001 Rinzler et al. ..... 40/590
6,339,889 B1 * 1/2002 Griesemer et al. ..... 40/603
6,513,272 B2 2/2003 Richards et al. ..... 40/603
6,530,165 B2 * 3/2003 Griesemer et al. ..... 40/603

* cited by examiner

*Primary Examiner*—Blair M. Johnson
(74) *Attorney, Agent, or Firm*—Fulbright & Jaworski L.L.P.

(57) ABSTRACT

A mounting system is disclosed for the mounting of a sheet on a roll-up door. The sheet is contemplated to have top and bottom opposed edges with continuous beads therealong for association with the mounting system. An elongate frame member is fixed to an upper one of the elongate panels in the elongate direction thereof. The frame member includes a mortise to receive the continuous bead along the top edge of the sheet. An elongate spring cover is mounted to one of the lower elongate panels of the roll-up door and has an access opening facing toward the elongate frame member. Springs are affixed within the elongate spring cover and attached to an elongate attachment which also includes a mortise to receive the continuous bead of the bottom edge of the sheet. The assembly of the springs, elongate attachment and sheet extend through the access opening. Engagement holes may be arranged in the elongate attachment to anchor the attachment for assembly of the sheet with the mounting system while the sheet is not in tension.

13 Claims, 4 Drawing Sheets

MOUNTING SYSTEM FOR SHEET MATERIAL ON ROLL-UP DOORS

BACKGROUND OF THE INVENTION

The field of the present invention is apparatus for the mounting of sheet material.

Advertising and other information is often temporarily presented on large sheets which are placed on billboards, truck panels and the like. One form of such sheet material is tensioned vinyl sheet. The sheet may be printed upon and surrounded by a more rigid plastic border which is RF welded to the sheet. The border typically includes a large bead, circular in cross section, which operates as a tenon in association with a C-shaped mortise associated with the mounting frame.

Mounting frames may take on a plurality of configurations. Of value is the ability to tension the sheet and to maintain it in a tensioned and wrinkle-free state. Mechanisms have been used which first lock the sheet in place and then apply tension through off center bolts and the like.

A recent system includes a mounting for a sheet that has a bead about its periphery. The system includes frame members forming a rectangle with each frame member having mutually parallel multiple engagement surfaces defined on ribs. As one utility, the frame has been mounted on the sides of trucks for advertising. The system further includes elongate retainers having elongate flanges with interlocking surfaces that can selectively interlock with one of the engagement surfaces on the frame members and retainer mortise elements to receive the tenon beads on the periphery of the sheet. The frame also has frame rails having rail surfaces that face away from corresponding retainer rail surfaces on the rails of the retainers. A tool including pinch rollers squeezes the corresponding rail surfaces toward one another to place the sheet material held by the retainer in tension while the interlocking surface is engaged with the appropriate engagement surface. This system is illustrated in U.S. Pat. Nos. 6,276,082 and 6,513,272, the disclosures of which are incorporated herein by reference.

The foregoing panels have found substantial utility in presenting printed indicia for identification and advertising. Further, the systems provide a covering for the sides of trucks which have become unsightly or included no longer appropriated printed indicia. As disclosed, the foregoing systems do not accommodate a surface which is subjected to dimensional change. Rear doors of many trucks are of the roll-up type which include a plurality of elongate panels with articulation therebetween. As the door is raised, the surface element height on the surface of the door increases as the panels transition from a vertical to a horizontal position. As such the surface element length of the door perpendicular to the elongate panels can increase by one-half to two inches while in transition between open and closed.

SUMMARY OF THE INVENTION

The present invention is directed to a mounting system including an elongate frame member which is fixed to one of an upper or lower one of the elongate panels of a roll-up door. Springs are attached to the other of an upper or lower one of the elongate panels of the roll-up door and engage an elongate attachment. The elongate frame member and the elongate attachment include mortises to receive continuous beads along the edges of a sheet to be mounted to the door.

In other aspects of the invention, the mounting system may further include an elongate spring cover within which the springs are mounted to mount the springs to one of the upper or lower panel of the door. These springs themselves may be advantageously coil springs in tension with a spring constant of about four pounds per inch. With four springs, the load variation on the door may be in the neighborhood of 64 lbs. An initial preload on the springs is also contemplated to maintain tension even with the door fully in the vertical position. Finally, engagement holes may be located on the elongate attachment sufficiently displaced within the spring cover from the access opening such that a tool such as a screwdriver may be used to extend the elongate attachment and retain it in that position while attaching the vinyl sheet without tension. These several additional aspects may be employed separately or in combination with the invention to added advantage.

Accordingly, it is an object of the present invention to provide an improved mounting system for sheet material on roll-up doors. Other and further objects and advantages will appear hereinafter.

DETAILED DESCRIPTION OF THE PREFERRED EMBODIMENT

Figure 1:
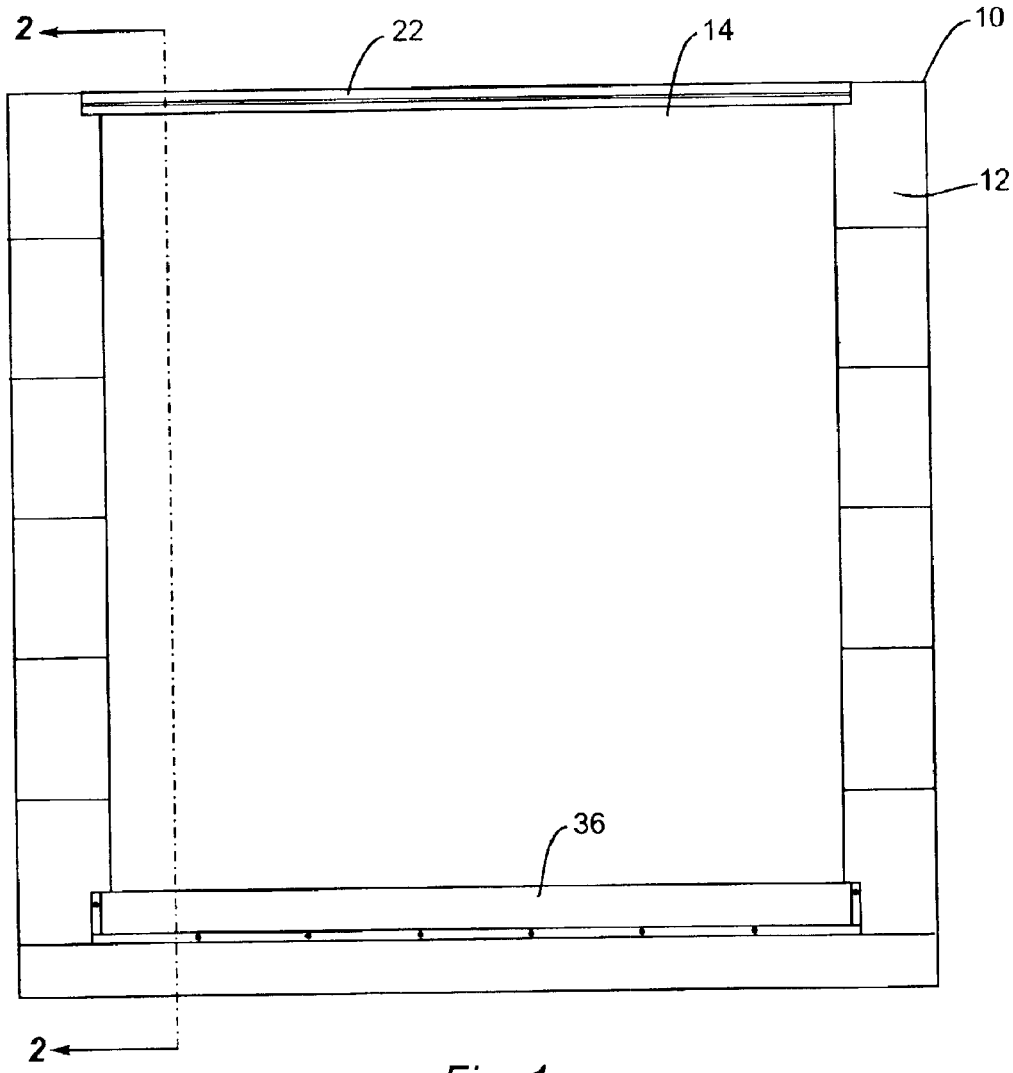
FIG. 1 is a front view of a sheet mounting system on a roll-up door.

Turning in detail to the drawings, FIG. 1 illustrates a roll-up door 10 including elongate panels 12 of conventional construction. The panels 12 extend fully across the door 10 and are linked to each adjacent panel. The roll-up door 10 may be mounted to a truck, for example, conventionally with tracks (not shown) to either side of the door to guide rollers (not shown) associated with each panel 12. The tracks run vertically at the doorway and then extend horizontally from the upper edge of the doorway. As the tracks are mounted behind the front face of the panels 12, gaps form between panels 12 as they transition upwardly from the vertical portion of the tracks to the horizontal portion of the tracks. This arrangement results in the surface dimension of the door perpendicular to the elongate panels 12 increasing by as much as two inches or more as the panels 12 transition from vertical to horizontal.

Figure 2:
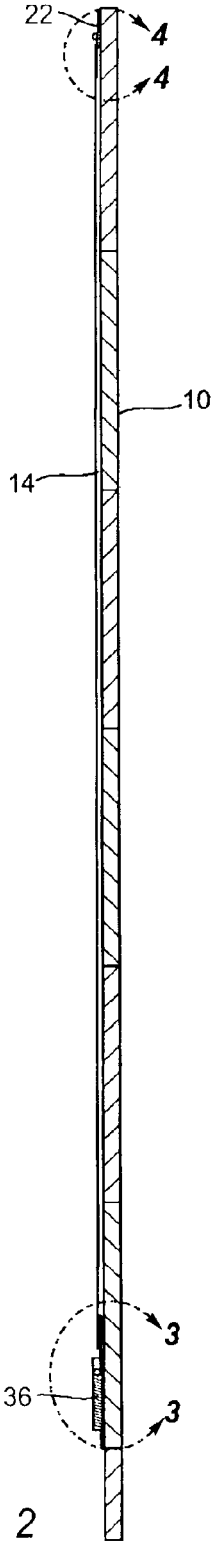
FIG. 2 is a cross-sectional view taken along line 2—2 of FIG. 1.
Figure 4:
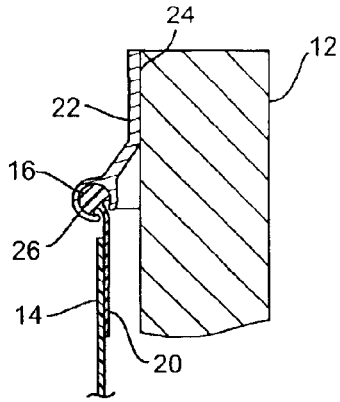
FIG. 4 is a detail view taken within line 4—4 of FIG. 2.
Figure 3:
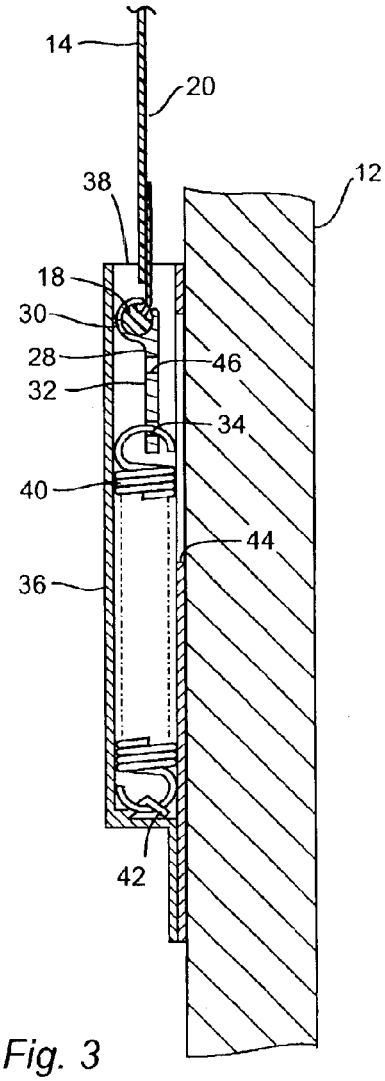
FIG. 3 is a detail view taken within line 3—3 of FIG. 3.
Figure 5:
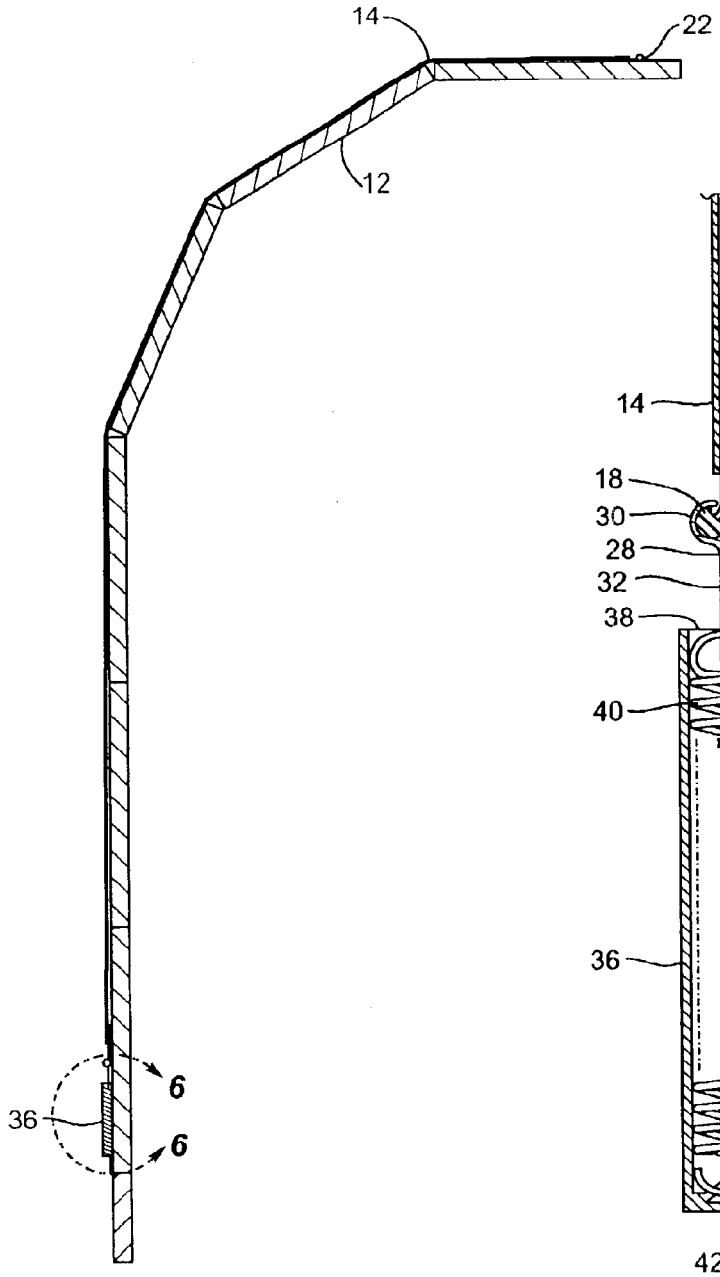
FIG. 5 is a cross-sectional view taken along 2—2 of FIG. 1 with the door partially raised.
Figure 6:
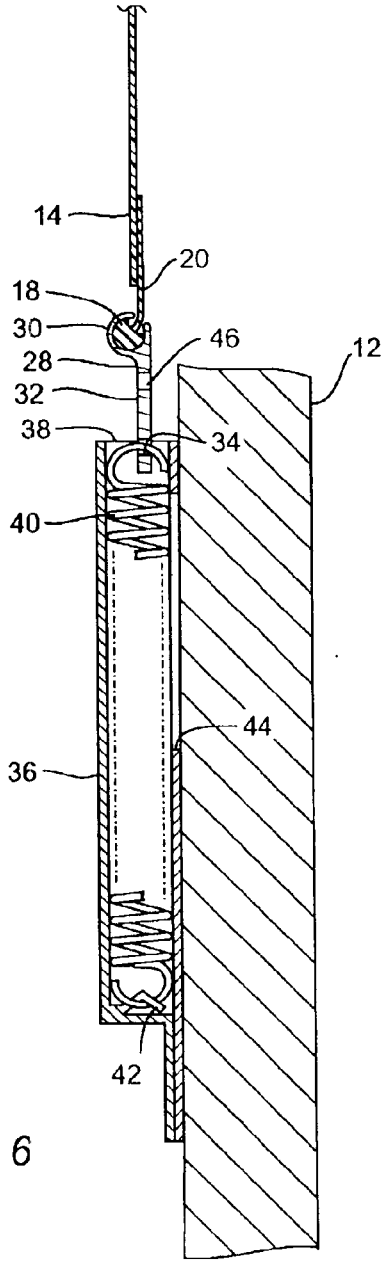
FIG. 6 is a detail view taken within line 6—6 of FIG. 5.

In FIG. 1 the door is shown to be closed and each elongate panel 12 is oriented vertically. In this configuration, the surface dimension of the roll-up door 10 perpendicular to the elongate panels 12 is at a minimum. This orientation is illustrated in FIGS. 2, 3 and 4 as well. As the door 10 is partially raised, the panels 12 move in an arc toward a horizontal position. This transition orientation is illustrated in FIGS. 5 and 6. In this circumstance, the aforementioned dimension increases with some oscillation to a maximum as the gap between adjacent panels 12 reaches the 45° mark on the curve.

A sheet 14 is shown to be mounted to the roll-up door 10. The sheet 14 is contemplated to be vinyl, which may be printed upon and tensioned when mounted. In this configuration, the sheet 14 has a rectangular periphery with the top edge having a continuous bead 16 and the bottom edge also having a continuous bead 18. These beads 16, 18 are preferably separately fabricated with an attached mounting sheet 20 welded or bonded to the sheet 14. The continuous beads 16, 18 are conveniently identical. Because the attachment is to a roll-up door 10, the sides of the sheet 14 are preferably not finished with a bead. In this instance, it is preferred that the side edges are simply folded over and welded back on the sheet 14 to provide added strength against tearing and the like.

The sheet 14 is shown in the illustrated embodiment to be attached by the continuous bead 16 to an elongate frame member 22. The elongate frame member 22 is preferably an extruded part of uniform cross section along its length. Screws, bolts or rivets may be applied through periodic holes in a mounting web 24 for attachment to one of the upper panels 12. A mortise 26, C-shaped in cross section, is formed with the mounting web 24 and extends outwardly a small distance away from the surface of the elongate panel 12 to which the elongate frame member 22 is mounted. The continuous bead 16 is introduced at one end of the elongate frame member 22 into the mortise 26 and threaded across to mount the sheet 14 to the frame member 22.

An elongate attachment 28 is associated with the lower continuous bead 18 in the illustrated embodiment. This elongate attachment 28 also employs a mortise 30 which is C-shaped and is formed with a mounting web 32. The elongate attachment 28 includes anchor elements 34 for retention. These anchor elements 34 are typically holes placed periodically through the mounting web 32 for attachment.

An elongate spring cover 36 is shown attached to one of the lowermost panels 12 and is arranged to extend in the elongate direction of the panel 12. The cover 36 includes an access opening 38 running substantially the length of the cover 36. This access opening 38 provides access for the introduction of the elongate attachment 28 and the bottom edge of the sheet 14 as can be seen in FIG. 3. The cover 36 is shown to have two parallel walls with a bottom wall and two end walls creating the spring cavity therein. A mounting flange extends around three sides of the cover 36. Holes through the mounting flange provide for fasteners to attach the device to the elongate panel 12.

Four coil springs 40 are arranged in the elongate spring cover 36. The springs 40 are attached to the bottom of the elongate spring cover 36 by mounts 42 and thereby are attached to the lower elongate panel 12. To provide for facile placement and attachment of the springs 40, rectangular holes 44 are provided through the back wall of the elongate spring cover 36 for access. The springs 40 are also attached to the anchor elements 34 of the mounting sheet 32. Through this mounting, the springs 40 operate in tension with the assembly. The four springs are configured to provide a spring constant of approximately four pounds per inch each. Further, the springs are arranged to be in preload with the door in the fully vertical position. The preload needs to be no more than about two pounds per spring.

The operation of the springs is illustrated through a comparison of FIGS. 3 and 6 in keeping with the orientation of the door 10 as illustrated in FIGS. 2 and 5, respectively. Preferably the relative dimensions are such that the coil springs 40 and the elongate attachment 28 are located within the elongate spring cover 36 with the door in the fully vertical, closed position. This provides some protection and improved aesthetics. As can be seen in FIG. 6, as tension is applied through the extension of the door, these components can extend outwardly of the cover 36.

For mounting a sheet 14, the elongate attachment 28 includes engagement holes 46. One engagement hole 46 is located near each end of the elongate attachment 28. The holes are located below the access opening with the springs 40 in the unloaded condition by an amount greater than the preload strain anticipated on the springs. The elongate attachment 28 can then be drawn upwardly to expose the engagement holes 46 though the access opening 38. A screwdriver or other bar may be extended through the engagement holes 46 to lie across the elongate spring cover 36. In this arrangement, the sheet 14 can be threaded into the mortises 26 and 30 without being in tension. To accommodate variations in sheet height, multiple such engagement holes 46 at different vertical locations can be provided in the elongate attachment 28.

The illustrated embodiment describes the elongate frame member 22 as being on an upper elongate panel 12 and the elongate attachment 28, springs 40 and elongate spring cover 36 as being on a lower elongate panel 12, although neither is required to be on the upper most or lower most panel 12. Another contemplated embodiment has the elongate frame member 22 as being on a lower elongate panel 12 and the elongate attachment 28, springs 40 and elongate spring cover 36 as being on an upper elongate panel 12. The entire mechanism would be simply mounted upside down from the illustrated embodiment. No other changes would be necessary from such a mounting. Among the advantages of this second mounting are the location of the mechanism with the springs out of the way and the lack of an upwardly open container, the elongate spring cover 36.

Figure 7:
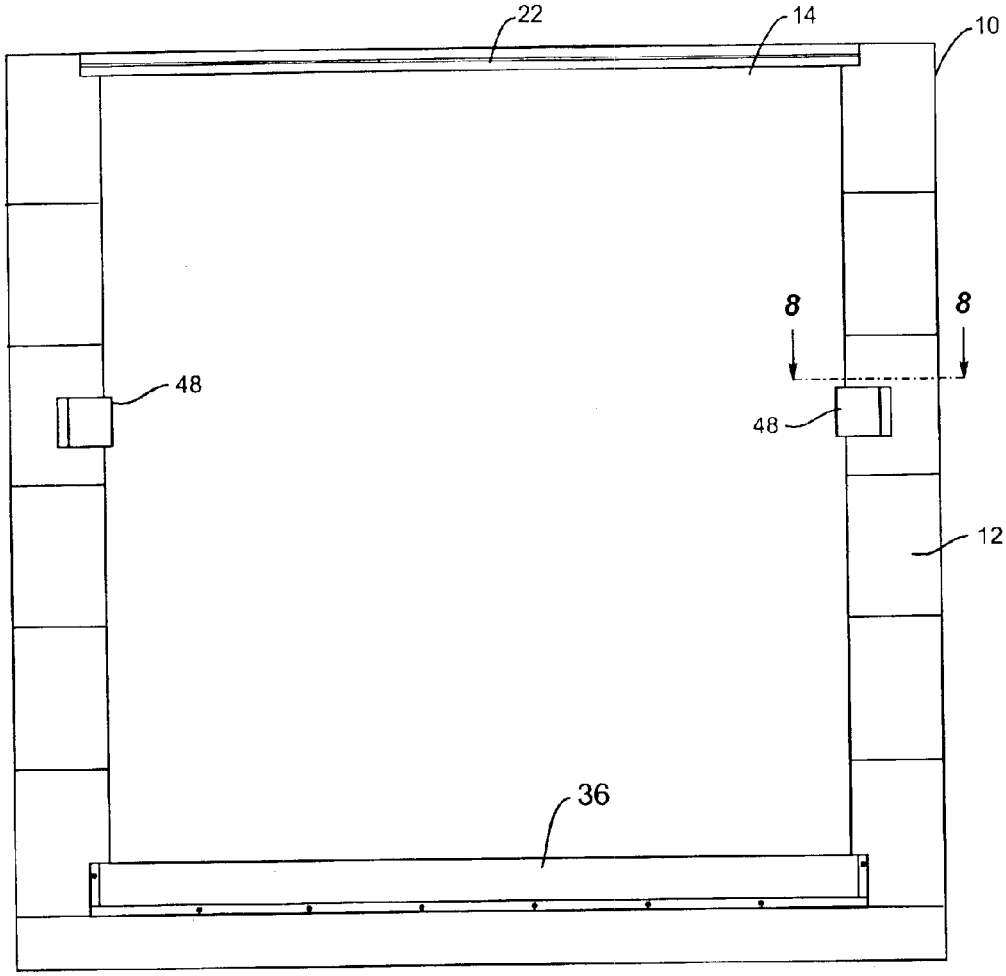
FIG. 7 is a front view of a sheet mounting system on a roll-up door having side tie-downs.
Figure 8:
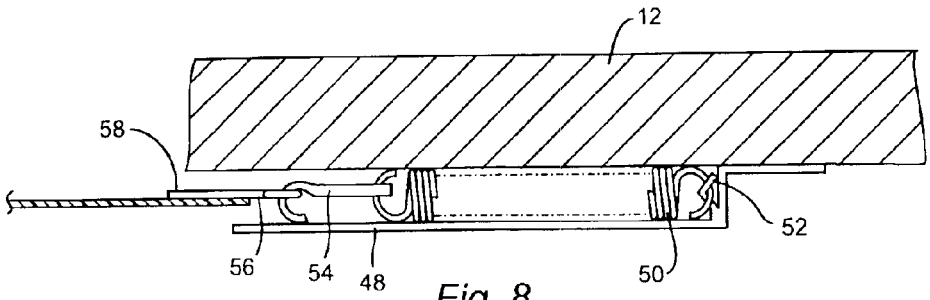
FIG. 8 is a cross-sectional view taken along 8—8 of FIG. 7.

An additional feature is illustrated in FIGS. 7 and 8. Side tie-downs are shown. A cover 48 is fixed to the elongate panel 12 on either side of the sheet 14. The cover 48 extends a small distance over the panel to hid the attachment. A spring 50 is retained within the cover 48 at an anchor 52. The other end of the spring engages a hook 54, which, in turn, engages an eyelet 56 formed in a short mounting sheet 58 welded or bonded to the sheet 14. Other arrangements could have the springs 50 attached directly, rather than indirectly, to the eyelet 56, without the short mounting sheet 58. If directly attached to the sheet 14, the sheet should be reinforced at the eyelet 56. The springs 50 will elongate and pivot as the sheet 14 moves in response to the door 10 being lifted or lowered.

Thus, an improved sheet mounting system for a roll-up door is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mounting system for mounting a sheet on a roll-up door having elongate panels, the sheet having a periphery defining at least top and bottom opposed edges with continuous beads therealong, comprising an elongate frame member fixed to one of an upper and a lower one of the elongate panels in the elongate direction of the panel and including a first mortise to receive the continuous bead along one of the opposed edges of the sheet;

an elongate attachment including a second mortise to receive the continuous bead along the other opposed edge of the sheet;

springs attached to the other of the upper and the lower one of the elongate panel and engaged with the elongate attachment to spring mount the elongate attachment parallel to and displaced from the elongate frame member;

an elongate spring cover attached to the other of the upper and the lower one of the elongate panel of the roll-up door and mounting the springs therein, the elongate spring cover including an access opening extending longitudinally to receive the elongate attachment engaged with the springs.

2. The mounting system of claim 1, the elongate attachment further including engagement holes sufficiently displaced within the spring cover from the access opening with the springs unloaded a distance greater than a predetermined preload strain on the springs.

3. The mounting system of claim 1, there being four of the said springs displaced from one another along the length of the elongate attachment, each with a constant of about four pounds per inch.

4. The mounting system of claim 3, the springs being tension coil springs.

5. The mounting system of claim 1 further comprising side tie-downs each including a cover fixed to a middle panel extending to over the sheet, a side spring attached at one end to the cover and at the other end to the sheet.

6. The mounting system of claim 5, the side tie-downs each further including a hook attached to the side spring and an eyelet in the sheet engaged with the hook to attach the side spring to the sheet.

7. The mounting system of claim 1, the elongate frame member being fixed to an upper one of the elongate panels and the springs being attached to a lower elongate panel.

8. A mounting system for mounting a sheet on a roll-up door having elongate panels, the sheet having a periphery defining at least top and bottom opposed edges with continuous beads therealong, comprising an elongate frame member fixed to one of an upper and a lower one of the elongate panels in the elongate direction of the panel and including a first mortise to receive the continuous bead along the top edge of the sheet;

an elongate attachment including a second mortise to receive the continuous bead along the bottom edge of the sheet;

tension coil springs displaced from one another and engaged with the elongate attachment to spring mount the elongate attachment parallel to and displaced from the elongate frame member;

an elongate spring cover attached to the other of the upper and the lower one of the elongate panel and mounting the springs therein, the elongate spring cover including an access opening extending longitudinally to receive the elongate attachment engaged with the springs, the elongate attachment further including engagement holes sufficiently displaced within the spring cover from the access opening with the springs unloaded a distance greater than a predetermined preload strain on the springs.

9. The mounting system of claim 8, each of the springs having a spring constant of about four pounds per inch.

10. The mounting system of claim 8, further comprising side tie-downs each including a cover fixed to a middle panel extending to over the sheet, a side spring attached at one end to the cover and at the other end to the sheet.

11. The mounting system of claim 10, the side tie-downs each further including a hook attached to the side spring and an eyelet in the sheet engaged with the hook to attach the side spring to the sheet.

12. The mounting system of claim 8, there being four of the said springs displaced from one another along the length of the elongate attachment, each with a spring constant of about four pounds per inch.

13. The mounting system of claim 8, the elongate frame member being fixed to an upper one of the elongate panels and the elongate spring cover being attached to a lower elongate panel.

* * * * *

UNITED STATES PATENT AND TRADEMARK OFFICE

CERTIFICATE OF CORRECTION

PATENT NO. : 6,945,300 B2
DATED : September 20, 2005
INVENTOR(S) : Marvin A. Smith It is certified that error appears in the above-identified patent and that said Letters Patent is hereby corrected as shown below:

Column 5,
Line 19, insert -- spring -- between “a” and “constant”.

Signed and Sealed this

Twenty-second Day of November, 2005

JON W. DUDAS
*Director of the United States Patent and Trademark Office*